United States Patent [19]

Tsuji

[11] Patent Number: 4,904,974

[45] Date of Patent: Feb. 27, 1990

[54] CONNECTING STRUCTURE OF COIL IN ELECTROMAGNETIC RELAY

[75] Inventor: Hideaki Tsuji, Yamagashi, Japan

[73] Assignee: Omron Tateisi Electronics Co., Kyoto, Japan

[21] Appl. No.: 322,013

[22] Filed: Mar. 13, 1989

[30] Foreign Application Priority Data

Mar. 14, 1988 [JP] Japan ..... 63-33583[U]

[51] Int. Cl.[4] ..... H01F 15/10

[52] U.S. Cl. ..... 336/192; 335/296

[58] Field of Search ..... 335/296, 299; 336/192, 336/198, 208

[56] References Cited

U.S. PATENT DOCUMENTS

| | | | |
|---|---|---|---|
| 822,469 | 6/1906 | Opitz | 336/192 |
| 3,230,490 | 1/1966 | Johnson | 336/192 X |
| 3,445,797 | 5/1969 | Otto | 336/192 |
| 4,347,493 | 8/1982 | Adams et al. | 336/192 |

*Primary Examiner*—George Harris

*Attorney, Agent, or Firm*—Wegner & Bretschneider

[57] ABSTRACT

According to the invention, a pair of pockets (13) are formed in one flange (12). A pair of almost L-shaped connecting terminals (14) are fitted into the pocket with a pressure. The starting and terminating sides (**10*a*, 10*b*) of a coil core wire (10**) are respectively wound around the connecting terminals. Thus, the cutting-out of the coil core wire is prevented and the connecting work can be easily performed.

2 Claims, 3 Drawing Sheets

CONNECTING STRUCTURE OF COIL IN ELECTROMAGNETIC RELAY

BACKGROUND OF THE INVENTION

1. Field of the Invention

The present invention relates to a connecting structure of a coil in an electromagnetic relay.

2. Description of the Prior Art

As an example of a coil connecting structure in a conventional electromagnetic relay, there has been known a structure as shown in FIGS. 5 and 6.

That is, a coil core wire 1 is wound around the outer periphery of a bobbin 2 to which a pair of flanges 3 are attached on both sides of the bobbin so as to face each other. A pair of pockets 5 consisting of enclosing grooves which are notched from both side portions of the flange 3 are formed in one of the flanges 3.

Coil lead wires 1*a* and 1*b* each of which is formed by extracting the coil core wire 1 or by twisting a plurality of coil core wires 1 and extracting the twisted wire are inserted into the pockets 5. The coil lead wire 1*a* on the starting side is inserted into one of the pockets 5 from the upper direction and its end portion is wound around the upper surface of a coil terminal 7*a* implanted onto a terminal base 6 and is soldered to the terminal 7*a* (refer to FIGS. 7 and 8).

The coil lead wire 1*b* on the terminating side is inserted into the other pocket 5 and its end portion is wound around the upper surface of another coil terminal 7*b* implanted onto the terminal base 6 and is soldered in a manner similar to the coil lead wire 1*a* on the starting side (refer to FIG. 7).

The insulation between the starting side 1*a* and the terminating side 1*b* of the coil lead wire 1 is accomplished by a barrier portion 4 formed on the upper surfaces of the pockets 5.

In the above coil connecting structure, the coil core wire 1 is connected with the coil terminals 7*a* and 7*b* by using the coil lead wires 1*a* and 1*b* each of which is an end portion of the coil core wire 1 or formed by twisting a plurality of coil core wire end portions. Therefore, there is a problem such that when a repetitive bending force due to the tension or vibration is applied to the coil lead wires 1*a* and 1*b*, they can be easily fatigued and cut out by the concentration of the stresses.

On the other hand, even in the case where the coil lead wires 1*a* and 1*b* are come into contact with the corner portions of the pockets 5 and the tension is applied to them, the coil lead wires 1*a* and 1*b* can be easily cut out by the pointed corner portions.

Moreover, since the coil lead wires 1*a* and 1*b* have the flexibility, there is also a problem such that the twisted core wires are projected and the good insulating property is not held.

Further, assuming that the end portions of such coil lead wires 1*a* and 1*b* were melted and bonded to the coil terminals 7*a* and 7*b*, the cross sections of the coil lead wires 1*a* and 1*b* decrease due to the dissolution and their strengths are weakened. Therefore, it is improper to connect the coil lead wires by the melt bonding method. Consequently, hitherto, the coil lead wires 1*a* and 1*b* are generally connected with the coil terminals 7*a* and 7*b* by soldering.

In the case of connecting the coil lead wires 1*a* and 1*b* with the coil terminals 7*a* and 7*b* by soldering, there are problems such that the flux produced upon soldering is diffused and deposited onto contacts (not shown) of the electromagnetic relay, so that a defective contact is caused and the like.

SUMMARY OF THE INVENTION

The present invention is made in consideration of the foregoing problems and it is an object of the invention to provide a coil connecting structure in an electromagnetic relay which has such toughness that it cannot be cut out even if a repetitive bending force due to a tension or vibration is applied and in which a melt bonding with coil terminals can be performed.

To accomplish the above object, according to the invention, there is provided an electromagnetic relay in which a pair of flanges are provided on both sides of a bobbin and a coil core wire is wound around the outer periphery of the bobbin, wherein the relay comprises: a pair of pockets which are formed in both side portions of one of the flanges and in each of which an enclosing groove is formed and a lateral groove is formed so as to be communicated with the enclosing groove; a pair of connecting terminals each of which has a thickness almost equal to a gap in the direction of thickness of the pocket and has a projecting portion adapted to be fitted into the lateral groove and is fitted into the pocket with a pressure, and wherein a starting side of the coil core wire is wound around one of the connecting terminals and a terminating side of the coil core wire is wound around the other connecting terminal.

That is, according to the invention, the connection with the coil terminals implanted onto the terminal base is not directly performed by the coil lead wires extracted from the coil core wire as in the conventional relay but is accomplished by a connecting structure such that an almost L-shaped connecting terminal having a thickness which is almost equal to a width of groove of the pocket and also having a projecting portion is provided and the connecting terminal is fitted into the pocket with a pressure. Therefore, the connecting terminal is inserted into the enclosing groove of the pocket and into the lateral groove and can be fixedly attached. At the same time, even if a repetitive bending force due to a tension or vibration is applied, the fatigue and cutting-out of the connecting terminal can be prevented.

On the other hand, since the connecting terminal is formed like a plate, its lower portion can be come into area contact with the upper surface of the coil terminal and the connection with the coil terminal can be executed by melt bonding. Thus, the connecting work can be easily performed and it is possible to eliminate such a problem that the diffused flux is deposited onto the connecting surface and a defective contact is caused as in the case of the soldering.

Therefore, according to the invention, it is possible to provide a coil connecting structure in which the reliability upon operation of a contact can be improved and the connecting work can be easily executed.

DETAILED DESCRIPTION OF A PREFERRED EMBODIMENT

An embodiment of the present invention will be described in detail hereinbelow with reference to the drawings.

Figure 2:
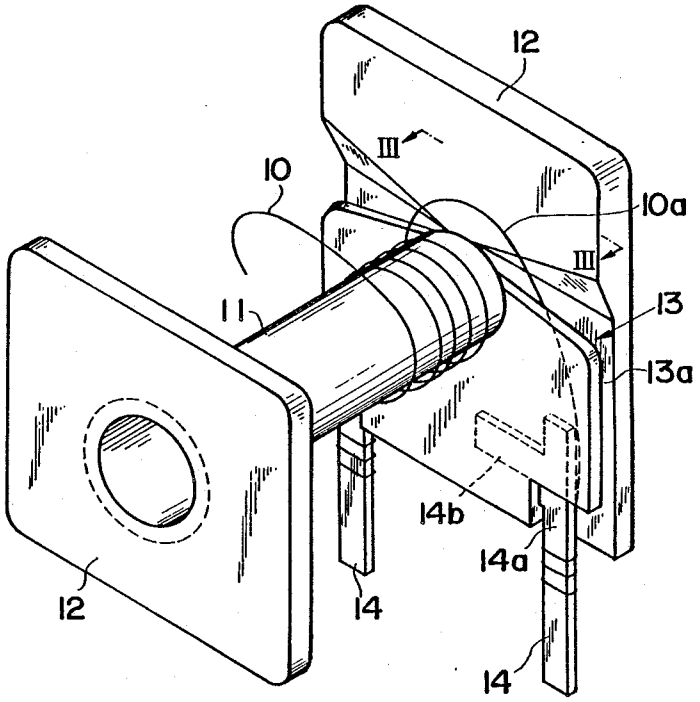
FIG. 2 is a perspective view showing an attaching state of a starting side connecting terminal according to the invention.
Figure 1:
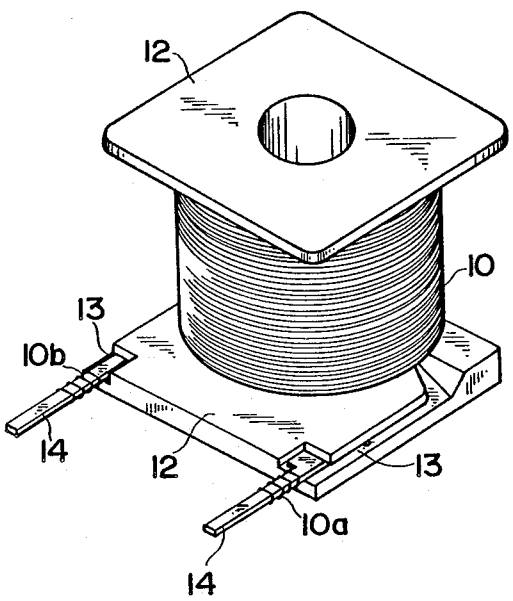
FIG. 1 is a perspective view showing a coil according to the present invention.

In FIGS. 1 and 2, a coil core wire 10 is wound around the outer periphery of a bobbin 11 to which a pair of flanges 12 are attached on both sides of the bobbin. On both sides of the coil core wire 10, relatively short coil lead wires 10*a* and 10*b* on the starting and terminating sides are extracted directly from the coil core wire 10 or are extracted after a plurality of coil core wires 10 were twisted.

A pair of pockets 13 are formed on the inside of one of the flanges 12. The pockets 13 are constructed by enclosing grooves 13*a* notched in parallel with the flange from both side surfaces of the flange 12.

Figure 3:
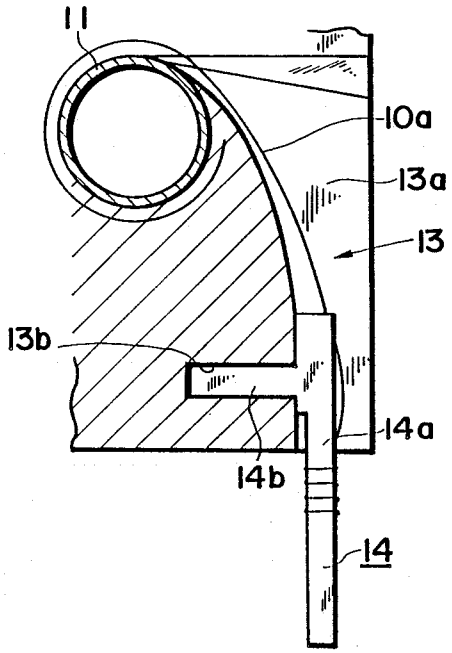
FIG. 3 is a cross sectional view taken along the line III—III in FIG. 2.
Figure 5:
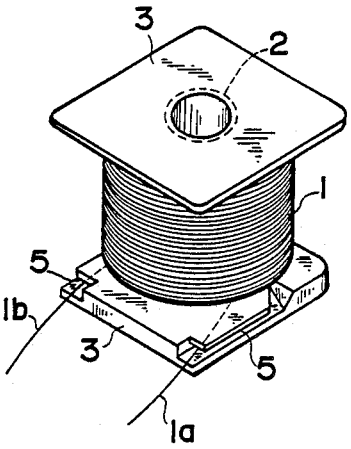
Fig.5 PRIOR ART
FIGS. 5 and 6 are perspective views showing an example of a coil according to a conventional electromagnetic relay.
Figure 6:
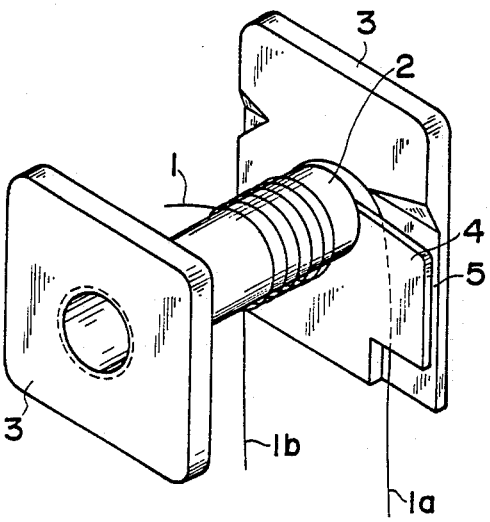
Fig.6 PRIOR ART
Figure 7:
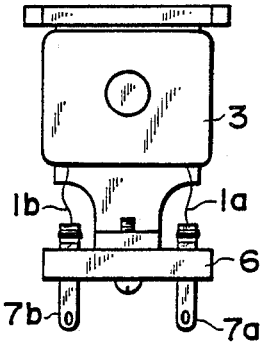
Fig.7 PRIOR ART
FIG. 7 is a front view showing an example of a coil connecting structure of a conventional electromagnetic relay.
Figure 8:
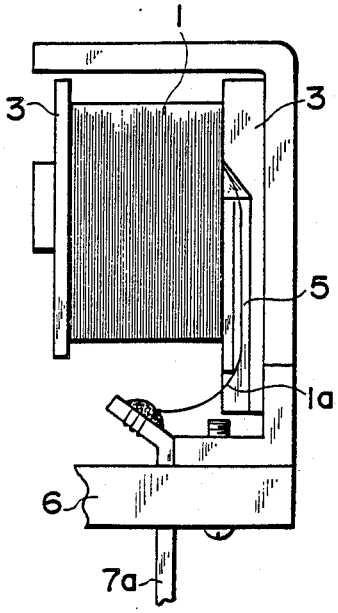
Fig.8 PRIOR ART
FIG. 8 is a side elevational view of FIG. 7.

On the other hand, as shown in FIG. 3, a lateral groove 13*b* communicating with the enclosing groove 13*a* is formed in the enclosing groove 13*a*. Further, the upper portion, lower portion, and side portion of the enclosing groove 13*a* are opened.

Reference numeral 14 denotes a connecting terminal inserted into the pocket 13. The connecting terminal 14 comprises: a rectilinear portion 14*a* which is inserted into the enclosing groove 13*a;* and a projecting portion 14*b* which is projected from the upper portion of the rectilinear portion 14*a* and is inserted into the lateral groove 13*b*. That is, as will be understood from FIG. 3, the connecting terminal 14 is formed into an almost L-shape. The coil lead wires 10*a* on the starting side and the coil lead wires 10*b* on the terminating side are respectively wound around the rectilinear portions 14*a* of the connecting terminals 14.

Figure 4:
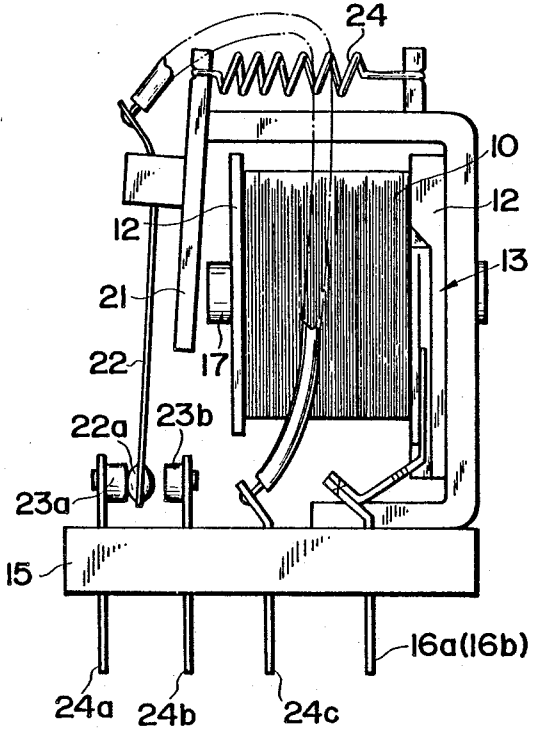
FIG. 4 is a side elevational view showing an electromagnetic relay having a coil connecting structure according to the invention.

On the other hand, as shown in FIG. 4, the lower portions of the connecting terminals 14 around which the coil lead wire 10*a* on the starting side and the coil lead wire 10*b* on the terminating side are respectively wound are joined to coil terminals 16*a* (and 16*b*) implanted onto a terminal base 15 and are melted and bonded by a high frequency melt bonding method or the like.

In FIG. 4, an electromagnetic coil is fixed to the terminal base 15. An iron core 17 is inserted and fixed into the bobbin 11. When a current is supplied through the coil core wire 10, an arm 21 is attracted to the iron core 17 against a force of a spring 24. Thus, a movable contact member 22 having a movable contact 22*a* attached to the arm 21 is swung and the movable contact 22*a* is away from a fixed contact 23*a* and is come into contact with a fixed contact 23*b*. The fixed contacts 23*a* and 23*b* are provided for terminals 24*a* and 24*b*. On the other hand, the movable contact 22*a* is connected to a terminal 24*c* through the movable contact member 22.

Since the invention is constructed as mentioned above, the starting side coil lead wire 10*a* and terminating side coil lead wire 10*b* of the coil core wire 10 are respectively wound around the connecting terminals 14, the connecting terminals 14 are fitted into the pockets 13 with a pressure and are area joined with the upper portions of the coil terminals 16*a* (and 16*b*) and both surfaces of the terminals 14 and 16*a* (16*b*) can be connected by the melt bonding method.

As described above, according to the coil connecting structure of the invention, the lateral groove is formed in the pocket and the almost L-shaped connecting terminal having the projecting portion is fitted into the pocket with a pressure. Therefore, the connecting terminal can be fixedly attached into the pocket. Even if a repetitive bending force due to the tension or vibration is applied, the fatigue and cutting-out of the connecting terminal do not occur.

On the other hand, since the connecting terminal can be easily joined with the coil terminal by the melt bonding method, the connecting terminal can be certainly easily attached. Moreover, since the flux which is used upon soldering is not used, there are advantages such that the contacting function is not deteriorated by the corrosion of the contact surfaces, and the like.

What is claimed is:

1. A coil connecting structure in an electromagnetic relay in which a pair of flanges are provided on both sides of a bobbin and a coil core wire is wound around an outer periphery of the bobbin, said structure comprising:

a pair of pockets which are provided in both side portions of one of said flanges and in each of which an enclosing groove is formed and a lateral groove is formed so as to communicate with said enclosing groove; and a pair of connecting terminals each of which has a thickness almost equal to a gap in the direction of thickness of said pocket and has a projecting portion adapted to be fitted into said lateral groove and is fitted into the pocket with a pressure, wherein a starting side of the coil core wire is wound around one of said connecting terminals and a terminating side of the coil core wire is wound around the other connecting terminal.

2. A structure according to claim 1, wherein said connecting terminals are melted and bonded to coil terminals at one end portion of each of said coil terminals.

* * * * *

UNITED STATES PATENT AND TRADEMARK OFFICE

CERTIFICATE OF CORRECTION

PATENT NO. : 4,904,974

DATED : February 27, 1990

INVENTOR(S) : Hideaki Tsuji

It is certified that error appears in the above-indentified patent and that said Letters Patent is hereby corrected as shown below:

Column 1, line 17, insert a comma (,) after "1b";

line 19, insert a comma (,) after "wire";

line 37, delete "by";

line 38, delete "using" and insert --via--;

line 38, insert -- ( -- after "1b";

line 38, insert --formed as-- after "is";

line 40, insert -- ) -- after "portions";

line 41, delete "repetitive";

line 42, delete "the", first occurrence;

line 42, insert --repeatedly-- after "is";

line 43, insert --broken-- after "and";

line 44, delete "cut out" and "the", second occurrence;

line 46, delete "come" and insert --brought--;

line 47, delete "the", second occurrence;

line 48, insert --broken-- after "easily";

line 49, delete "cut out";

UNITED STATES PATENT AND TRADEMARK OFFICE

CERTIFICATE OF CORRECTION

PATENT NO. : 4,904,974
DATED : February 27, 1990
INVENTOR(S) : Hideaki Tsuji

It is certified that error appears in the above-indentified patent and that said Letters Patent is hereby corrected as shown below:

line 50, delete "have" and insert --are flexible--;

line 51, delete "the flexibility" and "such";

line 52, delete "are projected and the good insulating" and insert --can dislocate from the pocket and defeat the insulating property of the pockets--;

line 53, delete "property is not held";

line 54, delete "assuming that" and insert --if--;

line 55, delete "were" and insert --are--;

line 57, delete "due to the dissolution and their" and insert --, thus weakening the lead wires--;

line 58, delete "strengths are weakened";

line 64, delete "there are";

line 65, delete "problems such that"; and line 66, insert --the-- after "onto".

Column 2, line 1, delete "is" and insert --may result--;

UNITED STATES PATENT AND TRADEMARK OFFICE

CERTIFICATE OF CORRECTION

PATENT NO. : 4,904,974
DATED : February 27, 1990
INVENTOR(S) : Hideaki Tsuji

It is certified that error appears in the above-indentified patent and that said Letters Patent is hereby corrected as shown below:

line 2, delete "caused and the like";

line 7, delete "has such toughness" and insert --is sufficiently tough--;

line 8, delete "cut out" and insert --broken--;

line 8, delete "repetitive";

line 9, insert --repeatedly-- after "is";

line 31, insert a comma (,) after "wire";

line 32, insert a comma (,) after "relay";

line 34, insert --a-- after "of";

line 40, delete "repetitive";

line 41, delete "a";

line 41, insert --repeatedly-- after "is";

line 41, delete "the";

line 42, delete "cutting out" and insert --breaking--;

UNITED STATES PATENT AND TRADEMARK OFFICE

CERTIFICATE OF CORRECTION

PATENT NO. : 4,904,974
DATED : February 27, 1990
INVENTOR(S) : Hideaki Tsuji

It is certified that error appears in the above-indentified patent and that said Letters Patent is hereby corrected as shown below:

line 45, delete "come" and insert --brought--;

line 47, delete "exe-" and insert --made--;

line 48, delete "cuted";

line 48, delete "connecting work can";

line 49, delete "be" and insert --connection is--;

line 49, insert --made-- after "easily";

line 50, insert --the-- before "problem" and insert --encountered when soldering-- after "problem";

line 51, delete "as";

line 52, delete "in the case of soldering";

line 55, delete "upon operation";

line 55, delete "a";

line 55, insert --operation-- after "contact";

line 56, delete "connecting work" and insert --connection--;

line 56, insert --made-- after "easily"; and line 56, delete "executed".

UNITED STATES PATENT AND TRADEMARK OFFICE

CERTIFICATE OF CORRECTION

PATENT NO. : 4,904,974

DATED : February 27, 1990

INVENTOR(S) : Hideaki Tsuji

It is certified that error appears in the above-indentified patent and that said Letters Patent is hereby corrected as shown below:

Column 3, line 26, insert --, which are-- after "13a" and insert a comma (,) after "parallel";

line 28, delete "On the other hand, as" and insert --As--;

line 37, delete "is projected" and insert --projects--;

line 45, delete "On the other hand, as" and insert --As--;

line 46, insert a comma (,) after "14";

line 49, insert a comma (,) after "wound";

line 57, delete "a" and insert --the--; and line 57, delete "Thus" and insert --This, in turn, causes--.

Column 4, line 1, insert --, attached to the arm 21 and-- after "22";

line 1, insert --, to swing-- after "22a" and delete "at-";

line 2, delete "tached to the arm 21 is swing";

line 3, delete "is away" and insert --, moves away--;

UNITED STATES PATENT AND TRADEMARK OFFICE

CERTIFICATE OF CORRECTION

PATENT NO. : 4,904,974

DATED : February 27, 1990

INVENTOR(S) : Hideaki Tsuji

It is certified that error appears in the above-indentified patent and that said Letters Patent is hereby corrected as shown below:

line 3, delete "come" and insert --brought--;

line 5, delete "On the";

line 7, insert --via-- after "24c";

line 12, insert --and-- after "14," and insert --held in-- after "into";

line 14, insert --. Thus,-- after "16b)";

line 20, insert --held in-- after "into";

line 24, insert --repeatedly-- after "is" and insert --breaking-- after "cutting-out";

line 26, change "on the other hand" to--Further and delete "since";

UNITED STATES PATENT AND TRADEMARK OFFICE

CERTIFICATE OF CORRECTION

PATENT NO. : 4,904,974
DATED : February 27, 1990
INVENTOR(S) : Hideaki Tsuji

It is certified that error appears in the above-indentified patent and that said Letters Patent is hereby corrected as shown below:

line 28, insert --thus facilitating ease of attachment-- after "method,";

line 29, insert --in-- after "used";

line 30, insert --employed-- after "not";

line 31, insert --of the contact surfaces-- after "function".

Signed and Sealed this

Second Day of November, 1993

Bruce Lehman

*Attest:*

BRUCE LEHMAN

*Attesting Officer*

*Commissioner of Patents and Trademarks*